US005090722A

United States Patent [19]

Ritchie et al.

[11] Patent Number: 5,090,722

[45] Date of Patent: Feb. 25, 1992

[54] TEMPORARY FOOT-GRIPPING DEVICE FOR SNOWBOARDS

[76] Inventors: Julian C. Ritchie, 4457 S.W. Wynnwood, Hillsboro, Oreg. 97123; Jaime L. Chriswisser, 12070 S.W. Fischer #A207, Tigard, Oreg. 97224

[21] Appl. No.: 562,837

[22] Filed: Aug. 6, 1990

[51] Int. Cl.[5] ..... A63C 5/03

[52] U.S. Cl. ..... 280/607; 280/11.3; 280/14.2; 441/70

[58] Field of Search ..... 280/14.2, 14.3, 607, 280/633, 636, 635, 615, 623, 600, 611, 87.042, 11.3; 441/70, 74, 75

[56] References Cited

U.S. PATENT DOCUMENTS

| | | | |
|---|---|---|---|
| 3,280,411 | 10/1966 | Brock | 441/70 |
| 3,437,345 | 4/1969 | Berta | 280/607 |
| 3,814,454 | 6/1974 | Beyl | 280/636 |
| 4,871,337 | 10/1989 | Harris | 280/14.2 |
| 4,973,073 | 11/1990 | Raines | 280/14.2 |

FOREIGN PATENT DOCUMENTS

| | | | |
|---|---|---|---|
| 80787 | 9/1952 | Norway | 280/635 |
| 99924 | 9/1940 | Switzerland | 280/635 |

*Primary Examiner*—David M. Mitchell

*Attorney, Agent, or Firm*—Chernoff, Vilhauer, McClung & Stenzel

[57] ABSTRACT

A device for temporarily gripping the booted foot of a snowboard user to provide the user with steering control of the snowboard. The temporary foot gripping device of the present invention does not replace the traditional bindings on snowboards, rather it supplements the bindings to give the snowboard user a means of temporarily securing the foot yet providing for quick and easy release so the foot may be used to push off against the ground. The device is designed to be securely fastened to a snowboard. The device is most useful to snowboard users when they are traveling over level ground in a "push and glide" sequence of motions, when the snowboard user is queueing for and mounting a ski lift, and riding the ski lift.

4 Claims, 1 Drawing Sheet

TEMPORARY FOOT-GRIPPING DEVICE FOR SNOWBOARDS

FIELD OF THE INVENTION

This invention relates to snowboards, and particularly to a temporary foot-gripping device that can be attached to a snowboard to provide rear-foot steering control of the board while traveling over level ground and also to support the snowboard with both feet while sitting on the ski lift.

BACKGROUND OF THE INVENTION

A snowboard provides a method of skiing on snow by means of a single ski. The skier attaches both feet to separate bindings on a single snowboard and glides downhill without using ski poles. A snowboard user is able to use gravity to glide down slopes, but, because he has both feet attached to the snowboard, he has no means of forward propulsion when stationary and on level or upwardly sloping ground. Therefore, in the absence of momentum, a snowboard user on level or upwardly sloping ground must remove a foot from the snowboard binding and use it against the ground to push off in order to glide forward. The push and glide sequence is repeated to continue forward movement. The rearward foot is used to push off, which may be the left or the right foot, depending upon the user's preference.

Pushing off on a rearward foot is effective as a means for propulsion but ineffective as a means for controlling the direction of motion and maintaining balance. When both feet are attached to the bindings, the snowboard is normally steered by shifting weight, or leaning, into the direction of the desired turn. This means of steering is significantly less effective when the rearward foot is outside the binding and merely sitting on the snowboard, than with both feet securely attached to the snowboard by bindings. When the rearward foot is not in the binding, the foot slides about on the slippery snowboard surface, making it difficult to put weight on the rearward foot and to use it for balance or steering.

To provide the rearward foot with a modicum of control when it is not in the binding, snowboard users typically affix a non-slip surface to their snowboards for the purpose of resting their rearward foot thereupon. One such non-slip surface is a product sold under the trademark GRIP-TAPE, which is an adhesive-backed tape that has a non-slip surface. The tape is adhered to the top surface of the snowboard such that the non-slip surface is exposed and provides friction to keep the user's rear foot from easily sliding about. Other conventional products for the same or similar purpose are sold under the trademarks TRACK-TOP, ASTRO DECK, and GORILLA GRIP, which are self-adhering pads of closed cell foam that may be affixed to the surface of the snowboard to provide a non-slip platform for the rear foot. However, none of these products for laying down a non-slip surface provide the rear foot with any significant steering control of the snowboard, but instead merely provide the snowboard user with a friction surface so that he may place weight on his rearward foot to maintain balance.

Another reason the rearward foot is removed from its binding is to comply with rules at many ski areas prohibiting snowboard users from mounting a ski lift with both feet in the bindings. Ski areas enacted the rule because skiers must maneuver into position in order to mount the ski lift and snowboard skiers with both feet in the bindings cannot maneuver about adequately. Thus, the snowboarder must ride the lift supporting the entire weight of the snowboard with only one foot in a binding.

SUMMARY OF THE INVENTION

The temporary foot gripping apparatus of the present invention is a device for attachment to a snowboard for solving the problem of control of the board when a rearward foot is not in the binding. In accordance with the present invention the device provides a means for temporarily securing the rearward foot to the snowboard so the user can effectively and safely steer the board, yet the foot may be easily and quickly removed from the securing device as needed, for propulsion or otherwise. Also, many ski areas have rules requiring that snowboard users remove one foot from the bindings while mounting the chair lift, thus the foot gripping apparatus provides the user with a temporary means of attachment so that both feet can support the weight of the snowboard during the chair lift ride.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
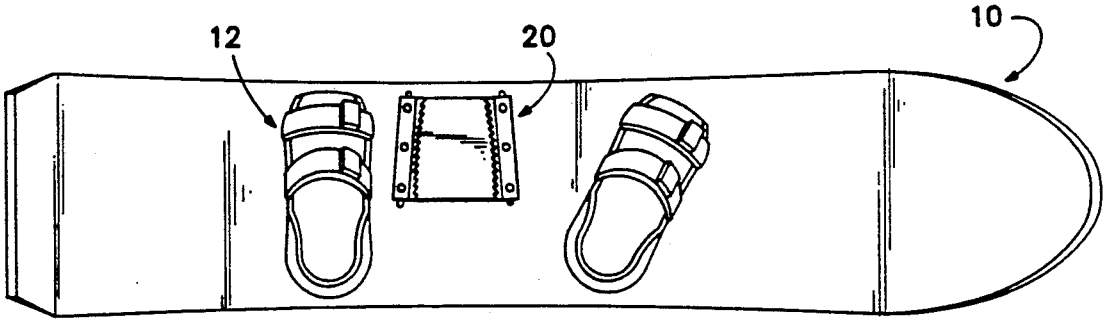
FIG. 1 is a plan view of a snowboard having two bindings mounted thereon and shows the temporary foot gripping device of the present invention.

In an exemplary embodiment, the temporary foot gripping device 20 of the present invention is mounted on a snowboard 10 adjacent and substantially parallel to the rear foot binding 12. The device 20 includes a base plate 30, two top plates 32, two grip plates 34, and numerous attachment means 33 for connecting the top plate and grip plate to the base plate.

Figure 2:
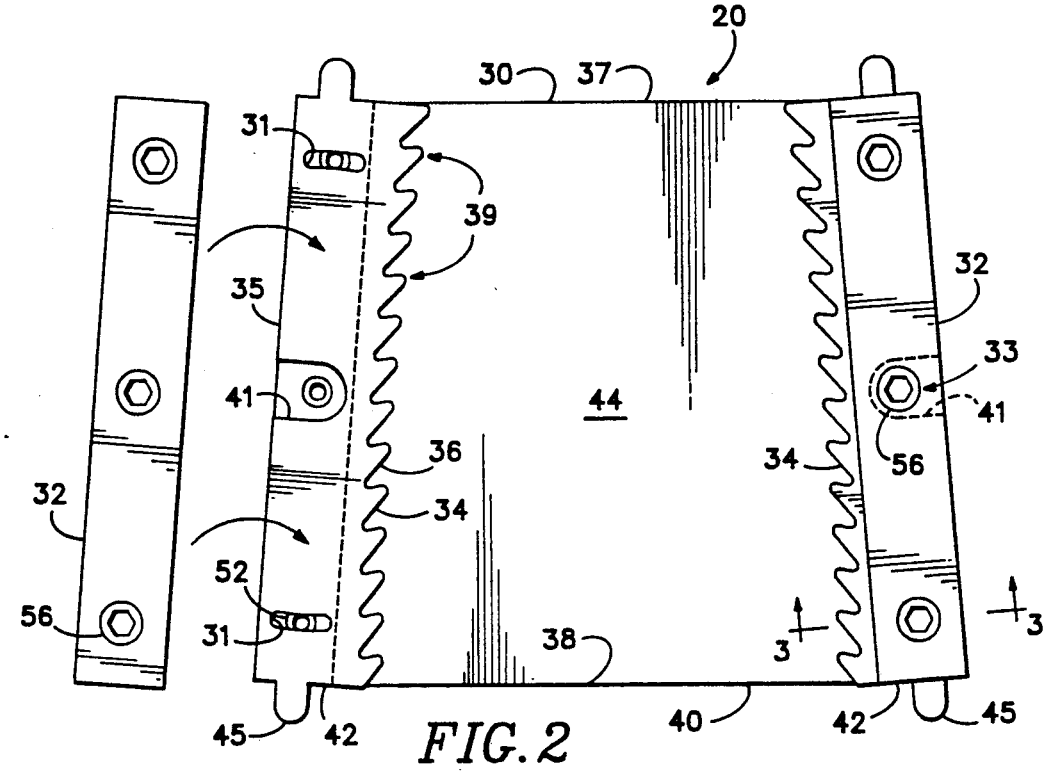
FIG. 2 is a plan view of the foot gripping device with one of its top plates removed to show the underlying serrated grip plate elements thereof.

In the plan view of FIG. 2, the base plate 30 has a generally trapezoidal shape with the upper edge 37 being substantially parallel to the lower edge 38 and of a shorter length relative thereto. When reviewed in a cross-section, as partially shown in FIG. 3, the base plate 30 is U-shaped, and includes a plate portion 40 and two upright arm portions 42. Taken together, the plate and arm portion form a shallow channel that is tapered along its length. The base plate has a top surface 44 intermediate the two upright arm portions 42, and its underside 46 is attached to an adhesive layer 48. (In a preferred embodiment, the adhesive on the underside of the foot gripping device is covered with contact paper 50 that is removed before the base plate is adhered to the snowboard surface. In normal commercial usage the snowboard user will purchase the foot grip device, remove the adhesive contact paper and then adhere the foot grip assembly to the snowboard as shown in FIG. 1.)

Figure 3:
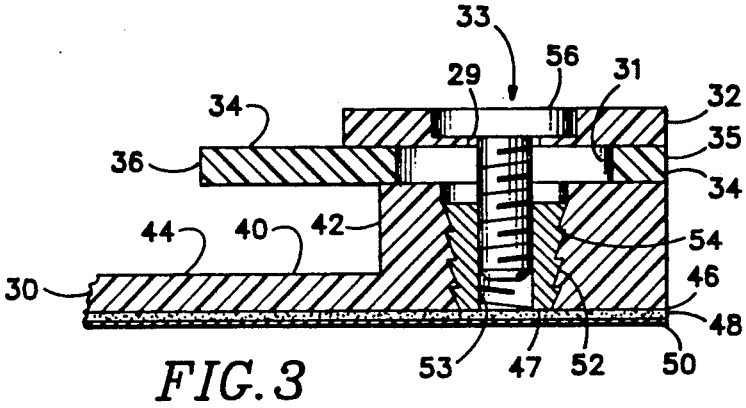
FIG. 3 is a partial cross-sectional view of the device of FIG. 2 as taken along the line 3—3.

Each arm portion 42 of the base plate 30 is provided with a plurality of cylindrically-shaped bore openings 47 adapted to forcibly receive and frictionally secure a threaded insert 52, as is best seen in FIG. 3. The threaded insert has a threaded bore 53 on the inside and protuberances 54 in the form of frustoconical ribs on its exterior surface for engaging a respective bore 47 in the arm portions 42. The external protuberances 54 on the threaded inserts will serve to prevent the insert from backing out once it is forced into the bore opening 47. The threaded bore 53 of each insert receives a similarly threaded attachment means, such as a bolt 56.

Each arm portion 42 supports a grip plate 34 that is in the form of an elongate strip of resilient material. One longitudinal edge 35 of the grip plate is substantially straight and the opposing longitudinal edge 36 is serrated along its entire length. The serrated edge has a line of teeth 39 which are slanted inward, towards the upper edge 37 of the base plate 30. The grip plate includes a pair of arcuate slots 31 and a U-shaped notch 41 between the slots. The U-shaped notch 41 serves to facilitate adjustment thereof, as will be explained below. At both ends of the straight longitudinal edge there are protruding adjustment tabs 45 which enable the user to adjust the angular orientation of the grip plate 34 within the limits provided by the slots 31.

The top plates 32 are in the form of an elongate strip having a plurality of holes 29 (exemplarily three) spaced therealong. (In FIG. 2 the holes are shown in each arm portion covered by the heads of bolts 56.) The top plate 32 is rigid and of a length substantially equal to the distance between the upper and the bottom edges 37, 38 of the base plate 30.

In assembling the device, each of the grip plates 34 is positioned on top of the respective arm portions 42 such that the slots 31 and notch 41 in the grip plate align over the threaded inserts 52 mounted in the arm portions. The grip plates are arranged such that their respective serrated edges 36 face one another and protrude past the edge of the arm portion, each forming a cantilever as is see in FIG. 3. The respective top plates 32 are then positioned over their respective grip plates 34; bolts 56 are respectively inserted through the holes in the top plates 29, next through the elongate slots 31 or the notch 41 in the grip plate and thence into the threaded inserts 52 mounted in the arm portions. Threading the bolts 56 into the respective threaded inserts and tightening the bolt heads against the top plate in turn tightens the grip plate against the arm portions, thus securing the grip plate into position and preventing movement of the grip plate relative to the base plate.

The grip plate may be adjusted by loosening the bolts 56. For example, referring to FIG. 2, the bolts 56 can be loosened, and force then applied to the adjustment tab 45 on the grip plate. The ends of the grip plates 34 may be adjusted independently due to the resilient nature of the grip plate material. The U-shaped notch 41 in the longitudinal straight edge of the grip plate prevents buckling or tearing of the grip plate material along the straight longitudinal edge during adjustment of the grip plate. Re-tightening the bolts will then maintain the grip plate in the desired position.

When the foot gripping device is attached to the snowboard, as shown in FIG. 1, the user may push his rearward foot into the foot gripping device 20 and thus connect his rearward foot to the snowboard, thereby providing greater steering control. The foot is inserted into the gripping device by positioning the toe of the foot over the lower edge 38, and then sliding the foot towards the upper edge 37, until the sides of the boot are grippingly contacted by the teeth 39 of the serrated edges 36 on the grip plates 34. When the forward portion of the foot encounters resistance from the grip plates, the snowboard user will then swivel his heel from side to side to force his foot further toward the upper edge 37, thus securing the foot in the foot gripping device which in turn is rigidly secured to the snowboard. In this position the foot is prevented from movement in the plane of the snowboard, the foot is prevented from moving toward the upper edge by the taper of the arm portions and grip plates, the foot is prevented from backward motion by frictional engagement with the serrated teeth, which are biased towards the upper edge, and side-to-side movement of the foot is prevented by the upright arm portions of the base plate. With the foot thus secured, the snowboard user has sufficient control to steer the snowboard in a manner substantially similar to the steering method when both feet are in the bindings.

The foot may be quickly and easily released from the foot gripping device. To remove his foot from the foot gripping device the snowboard user need merely lift his heel and roll his foot onto his toe and at the same time lift his foot in a direction substantially perpendicular to the plane of the snowboard.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A foot-gripping device for temporarily securing a person's shod foot to a snowboard, comprising:

(a) a planar plate adapted to be fastened to said snowboard;

(b) spaced-apart upright arm portions integral with the upper surface of said plate;

(c) clamp members respectively overlying each said upright arm portion; and (d) resilient means, located between respective said arm portions and said clamp members, for frictionally gripping and retaining the sides of a user's foot that is forcibly inserted onto said plate between said arm portions, said resilient means having a serrated, inwardly-extending edge.

2. A foot-gripping device for temporarily securing a person's shod foot to a snowboard, comprising:

(a) a planar, substantially trapezoidal plate adapted to be fastened to said snowboard;

(b) a spaced-apart pair of upright arm portions respectively aligned with the non-parallel edges of said trapezoidal plate and connected to the upper surface of said plate;

(c) a pair of clamp members connected to a respective said upright arm portion; and (d) a pair of resilient means each located between respective said arm portions and said clamp members, said resilient means extending inwardly toward each other in a cantilevered fashion and having a serrated edge along its inwardly-extending edge, for gripping and retaining the sides of a user's foot when forcibly inserted onto said plate between said arm portions.

3. A foot-gripping device for temporarily securing a person's shod foot to a snowboard, comprising:

(a) a planar, substantially trapezoidal plate adapted to be fastened to said snowboard;

(b) a spaced-apart pair of upright arm portions respectively aligned with the non-parallel edges of said trapezoidal plate and connected to the upper surface of said plate;

(c) a pair of resilient means each located on said arm portions for gripping and retaining the sides of a user's foot that is forcibly inserted between said arm portions; and (d) attachment means coupling together each resilient means with a respective arm portion for positioning said resilient means relative to its respective arm portion thereby adjusting said device to accommodate a variety of shod foot sizes and configurations.

4. The device of claim 3 wherein at least one of said respective resilient means is provided with an extending tab to facilitate user positioning of said means relative to its respective arm portion.

* * * * *